US009274487B2

(12) United States Patent
Ohnishi

(10) Patent No.: US 9,274,487 B2
(45) Date of Patent: Mar. 1, 2016

(54) IMAGE FORMING APPARATUS

(71) Applicant: CANON FINETECH INC., Misato-shi, Saitama-ken (JP)

(72) Inventor: Takahiro Ohnishi, Kashiwa (JP)

(73) Assignee: Canon Finetech Inc., Misato-shi (JP)

( * ) Notice: Subject to any disclaimer, the term of this patent is extended or adjusted under 35 U.S.C. 154(b) by 315 days.

(21) Appl. No.: 13/923,578

(22) Filed: Jun. 21, 2013

(65) Prior Publication Data

US 2014/0003846 A1 Jan. 2, 2014

(30) Foreign Application Priority Data

Jun. 29, 2012 (JP) ..... 2012-147806

(51) Int. Cl.
*G03G 15/00* (2006.01)
*G03G 15/20* (2006.01)

(52) U.S. Cl.
CPC ..... *G03G 15/6573* (2013.01); *G03G 15/2028* (2013.01); *G03G 15/6594* (2013.01); *G03G 15/2085* (2013.01); *G03G 2215/00514* (2013.01)

(58) Field of Classification Search
CPC ..... G03G 2215/00514; G03G 2215/00417; G03G 2215/00413; G03G 2215/00421; G03G 2215/20; G03G 15/2085; G03G 15/6573; G03G 15/2028; G03G 15/6594
USPC ..... 399/322; 347/155; 271/2
See application file for complete search history.

(56) References Cited

U.S. PATENT DOCUMENTS

2004/0169329 A1 9/2004 Kobayashi et al.

FOREIGN PATENT DOCUMENTS

| | | | |
|---|---|---|---|
| CN | 1542559 | A | 11/2004 |
| JP | 64-80978 | A | 3/1989 |
| JP | 5-4731 | A | 1/1993 |
| JP | 5-6054 | A | 1/1993 |
| JP | 5-94067 | A | 4/1993 |

OTHER PUBLICATIONS

Machine translation of JP 05-094067.*
Japanese Office Action dated Sep. 9, 2014, issued in counterpart Japanese Application No. 2012-147806.
Jan. 2, 2014 European Office Action in European Application No. 13173943.5.

(Continued)

*Primary Examiner* — David Gray
*Assistant Examiner* — Andrew V Do
(74) *Attorney, Agent, or Firm* — Fitzpatrick, Cella, Harper & Scinto

(57) ABSTRACT

To prevent a flap of an envelope from sticking to an envelope main body, an image forming apparatus includes: an image forming portion forming a toner image on the envelope; a fixing device fixing the toner image onto the envelope by heating the envelope while conveying the envelope on which the toner image is formed by the image forming portion; and a conveying roller pair that rotates while nipping the envelope, onto which the toner image is fixed by the fixing device, to convey the envelope. A driven roller of the conveying roller pair includes driven runners divided in a rotary shaft center direction, and one driven runner located at one end is inclined in a direction separating from another driven runner so that an outer peripheral surface of the one driven runner is brought into contact with a corner portion of a rubber roller.

11 Claims, 12 Drawing Sheets

(56) References Cited

OTHER PUBLICATIONS

Aug. 27, 2015 Office Action in counterpart Korean Patent Application No. 10-2013-0075140.

Jun. 30, 2015 Office Action in counterpart Chinese Patent Application No. 201310263961.7 and English translation thereof.

* cited by examiner

RELATIONSHIP BETWEEN MOISTURE CONTENT OF ENVELOPE AND STICKING STRENGTH OF ENVELOPE

RELATIONSHIP BETWEEN INCLINATION ANGLE OF DRIVEN RUNNER WITH RESPECT TO RUBBER ROLLER AND CONTACT WIDTH BETWEEN DRIVEN RUNNER AND RUBBER ROLLER

| INCLINATION (°) | CONTACT WIDTH (mm) |
|---|---|
| 0 | 8 |
| 0.5 | 6 |
| 2 | 2 |
| 4 | 1 |

RELATIONSHIP BETWEEN CONTACT WIDTH OF CONVEYING ROLLER PAIR AND STICKING STRENGTH OF ENVELOPE

IMAGE FORMING APPARATUS

BACKGROUND OF THE INVENTION

1. Field of the Invention

The present invention relates to an image forming apparatus which is configured to fix a toner image on an envelope.

2. Description of the Related Art

Hitherto, an image forming apparatus employing an electrophotographic system, such as a copying machine and a printer, has been configured to fix a toner image on an envelope, onto which the toner image is formed by an image forming portion, by conveying and heating the envelope with use of a fixing device. After that, in the image forming apparatus, the envelope is nipped by a pair of rotary members, and is conveyed by the rotation thereof. When the envelope is heated by the fixing device, the moisture in the envelope often evaporates.

A water-soluble adhesive is often applied to the flap (flap part) of the envelope. Therefore, when the envelope is heated by the fixing device, the moisture of the envelope may evaporate, and the adhesive applied to the flap may dissolve by the evaporated moisture. When the envelope is nipped thereafter by a conveying roller or the like, the flap may stick to the envelope main body.

There is known an image forming apparatus including a flap releasing mechanism for forcibly separating the flap from the envelope main body in order to prevent the flap from sticking to the envelope main body (Japanese Patent Application Laid-Open No. H05-94067).

The flap releasing mechanism of the conventional image forming apparatus has a certain size, and is provided at a position at a distance from the fixing device. Therefore, the flap releasing mechanism often peels off the flap after the flap is stuck to the envelope main body, and thus the envelope is damaged in some cases.

SUMMARY OF THE INVENTION

The present invention provides an image forming apparatus which is capable of preventing a flap of an envelope from sticking to the envelope main body.

According to an exemplary embodiment of the present invention, there is provided an image forming apparatus, including: an image forming unit that forms a toner image on an envelope; a fixing unit that fixes the toner image onto the envelope by heating the envelope while conveying the envelope on which the toner image is formed by the image forming unit; and a conveying unit that conveys the envelope, onto which the toner image is fixed by the fixing unit, so that an adhesion portion of a flap of the envelope separates from a main body of the envelope.

In the image forming apparatus according to the exemplary embodiment of the present invention, a conveying surface of one rotary member in a pair of rotary member, which nips and conveys the flap, of the pairs of rotary members is inclined in a direction separating from a conveying surface of another rotary member in the pair of rotary member, which nips and conveys the flap, so as not to nip the adhesion portion of the flap. Thus, the flap may be separated from the main body of the envelope to prevent the flap from sticking to the main body.

Further features of the present invention will become apparent from the following description of exemplary embodiments with reference to the attached drawings.

DESCRIPTION OF THE EMBODIMENTS

In the following, an image forming apparatus according to each embodiment of the present invention is described with reference to the drawings. The numerical values in the embodiments are reference numerical values, and are not numerical values that limit the present invention.

Figure 1:
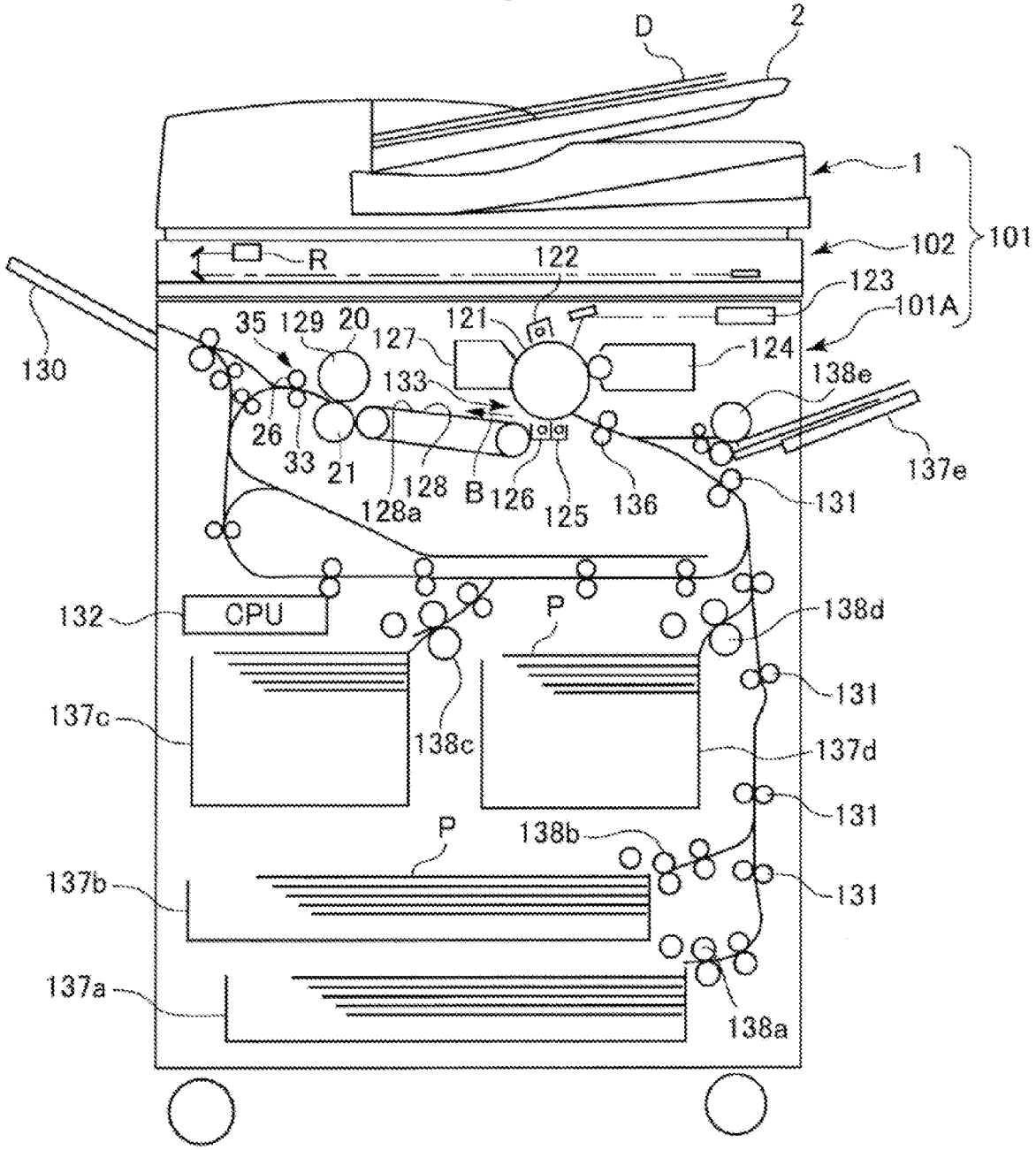
FIG. 1 is a sectional view of an image forming apparatus according to an embodiment of the present invention.

FIG. 1 is a sectional view of an image forming apparatus according to an embodiment of the present invention.

An image forming apparatus 101 includes an apparatus main body 101A, an image reader 102 provided on an upper portion of the apparatus main body, and an original feeder 1 provided on the image reader 102.

The original feeder 1 automatically conveys an original D placed on an original feeding tray 2 by a user to the image reader 102. The image reader 102 receives, at an image reading position R, light radiated to and reflected on the original that is conveyed inside the original feeder 1, optically reads the original for conversion into an electrical signal, and creates image data (image reading information) based on the electrical signal.

The apparatus main body 101A of the image forming apparatus 101 forms, based on the image data, a copy image on an envelope. The apparatus main body 101A causes an exposure portion 123 to operate based on the electrical signal and image data of the image on the original, to thereby form an electrostatic latent image on a surface of a rotatable photosensitive drum 121. The electrostatic latent image is developed (supplied with toner) by a developing device 124 and becomes a toner image.

On the other hand, at a lower portion of the apparatus main body 101A, envelope placing portions 137*a*, 137*b*, 137*c*, and 137*d* are arranged, which are loaded with various sizes of envelopes P. The envelopes P in the envelope placing portions 137*a*, 137*b*, 137*c*, and 137*d* are taken out one by one by feeding rollers 138*a*, 138*b*, 138*c*, and 138*d*, respectively, to be passed to conveying rollers 131. The envelopes are also taken out one by one from a manual feed tray 137*e* by a feeding roller 138*e*.

After that, the skew feed of the envelope P is corrected by a registration roller pair 136, and the envelope P is supplied between the photosensitive drum 121 and a transfer charging device 125 at a synchronized timing so that the envelope P is aligned with the position of the toner image on the photosensitive drum 121. The toner image on the photosensitive drum is transferred onto the envelope P by the transfer charging device 125, and the envelope P is separated from the photosensitive drum 121 by a separation charging device 126. A cleaner 127 cleans the surface of the photosensitive drum 121 after transfer of the toner image. A charging device 122 charges the surface of the photosensitive drum 121 to prepare for the next exposure.

The envelope P having the toner image transferred thereon is conveyed by a conveying portion 128 to a fixing device 129, and is heated and pressurized by the fixing device 129 to fix the toner image on the surface thereof. The envelope P having the toner image fixed thereon is delivered by a conveying roller pair 35 to a delivery tray 130.

The image forming apparatus 101 is controlled by a control portion 132 (FIG. 1) including a CPU. The photosensitive drum 121, the charging device 122, the developing device 124, and the like are included in an image forming portion 133 serving as an image forming unit for forming a toner image on an envelope.

Figure 2:
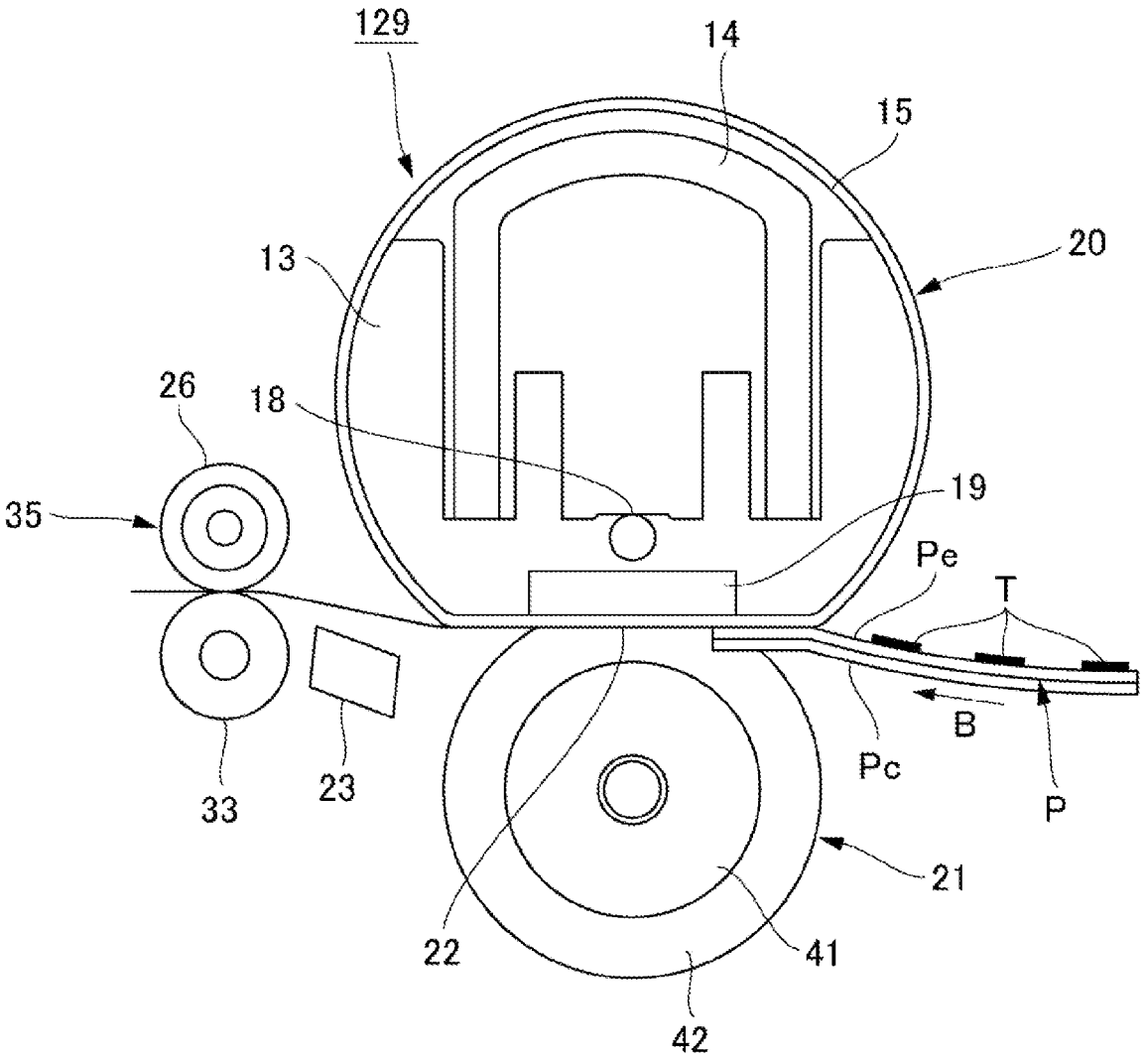
FIG. 2 is a schematic sectional view of a fixing device.

FIG. 2 is a schematic sectional view of the fixing device 129.

The fixing device 129 serving as a fixing unit includes a film unit 20 having a diameter of 30 mm and a pressure roller 21 having a diameter of 25 mm, which serve as a fixing rotary member pair. The fixing device 129 heats the envelope P having a toner image T formed thereon by the image forming portion 133 while conveying the envelope P, to thereby fix the toner image T onto the envelope P.

The film unit 20 includes a heating source 19, fixing film 15, a film guide 13, a fixing stay 14, and a temperature detecting element 18. The film unit 20 is located on the same side as the photosensitive drum 121 with respect to the arriving envelope.

As the heating source 19, a ceramic heater is used. The ceramic heater includes a heat generating body in which heat generating paste is printed on a ceramic substrate, and a glass coating layer for protecting and securing the insulating property of the heat generating body. A power-controlled AC current is supplied to the heat generating body to generate heat.

The fixing film 15 is formed of a cylindrical polyimide sheet having a thickness of about 70 μm, and transmits the heat from the heating source 19 efficiently to the toner image T on the envelope P. The film guide 13 includes many ribs in its longitudinal direction so as to reduce the resistance with respect to the fixing film 15 and assist the rotational sliding of the fixing film 15 which rotates in association. The fixing stay 14 is formed of a steel plate, and uniformly applies a pressure force from the pressure roller 21 to the film guide 13. The temperature detecting element (thermistor) 18 provided on the rear side of the ceramic heater detects the temperature change of the heating source 19 to control the power for the heating source 19 in accordance with a target temperature of the heating source 19. Thus, the temperature of the heating source 19 is maintained to the target temperature (print temperature).

The pressure roller 21 is formed by covering a core metal 41 made of aluminum and having a diameter of 20 mm with a silicone rubber 42. The pressure roller 21 is provided in pressure contact to the heating source 19 with the fixing film 15 being disposed therebetween by a spring (not shown) at a predetermined pressure (nip pressure), to thereby form, together with the film unit 20, a fixing nip portion 22 having a width of 5 mm to 8 mm in the conveying direction of the envelope P. The pressure roller 21 is rotationally driven by a drive source (not shown) for the pressure roller so as to rotate the fixing film 15 in association thereto, and conveys the envelope P sent to the fixing nip portion 22 under a state in which the envelope P is brought into close contact with the fixing film 15.

When the envelope P is sent to the fixing nip portion 22, the fixing device 129 fixes the unfixed toner image T borne on the envelope P onto the envelope P by the heat from the heating source 19 and the nip pressure of the fixing nip portion 22. The envelope P having the toner image T fixed thereon is sent along a delivery guide 23 to the conveying roller pair 35 including a drive roller 26 and a driven roller 33, and is delivered onto the delivery tray 130.

Figure 3A:
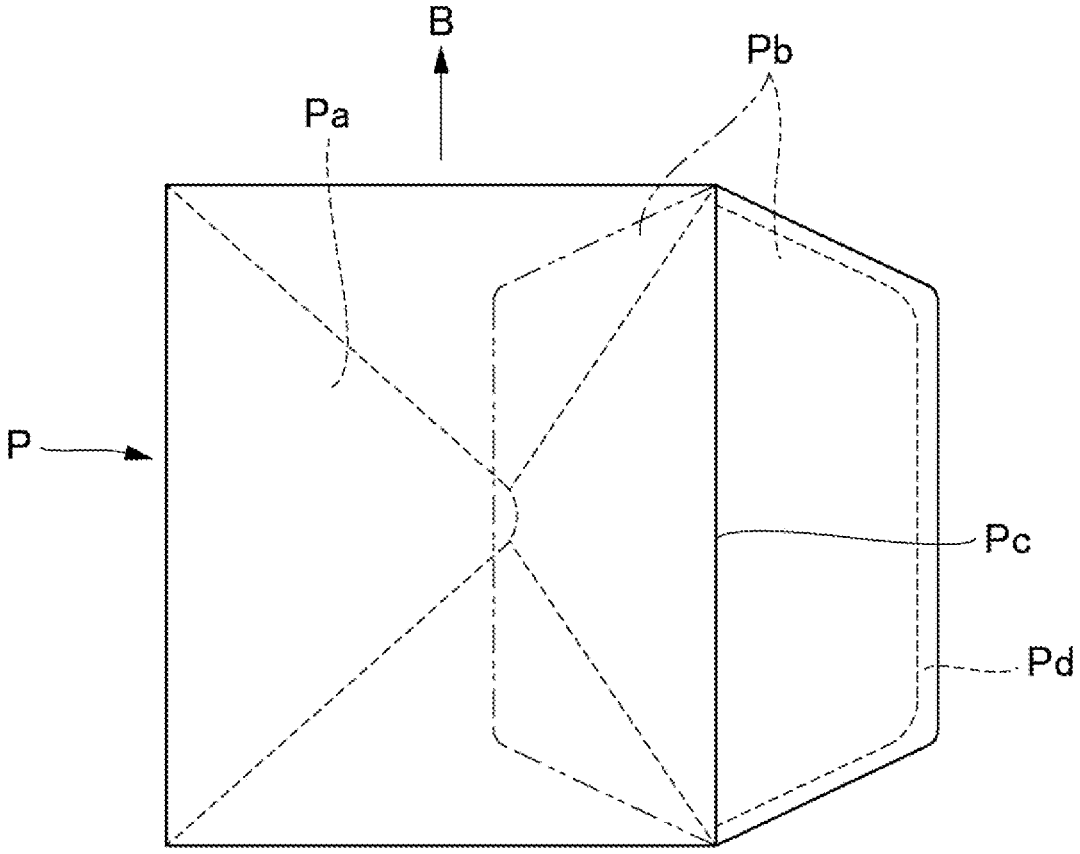
FIG. 3A is a plan view of an envelope, in which a surface on which the address is to be written is directed upward.
Figure 3B:
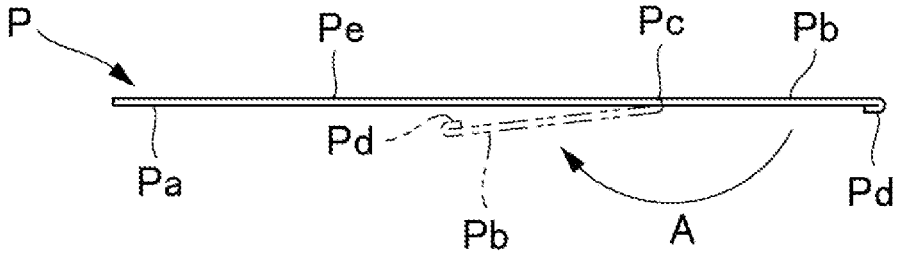
FIG. 3B is a side view of the envelope.

FIGS. 3A and 3B illustrate the envelope P. FIG. 3A is a plan view of the envelope, in which the surface on which the address is to be written is directed upward. FIG. 3B is a side view of the envelope.

The envelope P is an open side envelope. The envelope P is formed of a bottomed tubular main body Pa and a flap Pb. The flap Pb is folded in an arrow A direction at a fold line Pc at a boundary between the flap Pb and the main body Pa, and thus the main body Pa is opened and closed. Onto the edge of the flap Pb, an adhesive Pd is applied so that the flap Pb adheres to the main body Pa when the main body Pa is closed by the flap Pb. The envelope P is conveyed in an arrow B direction under a state in which a surface Pe on which the address is to be written is directed on the side of the photosensitive drum 121 and the film unit 20 of the fixing device 129. That is, the address is written onto the envelope P by the image forming apparatus 101.

Figure 4A:
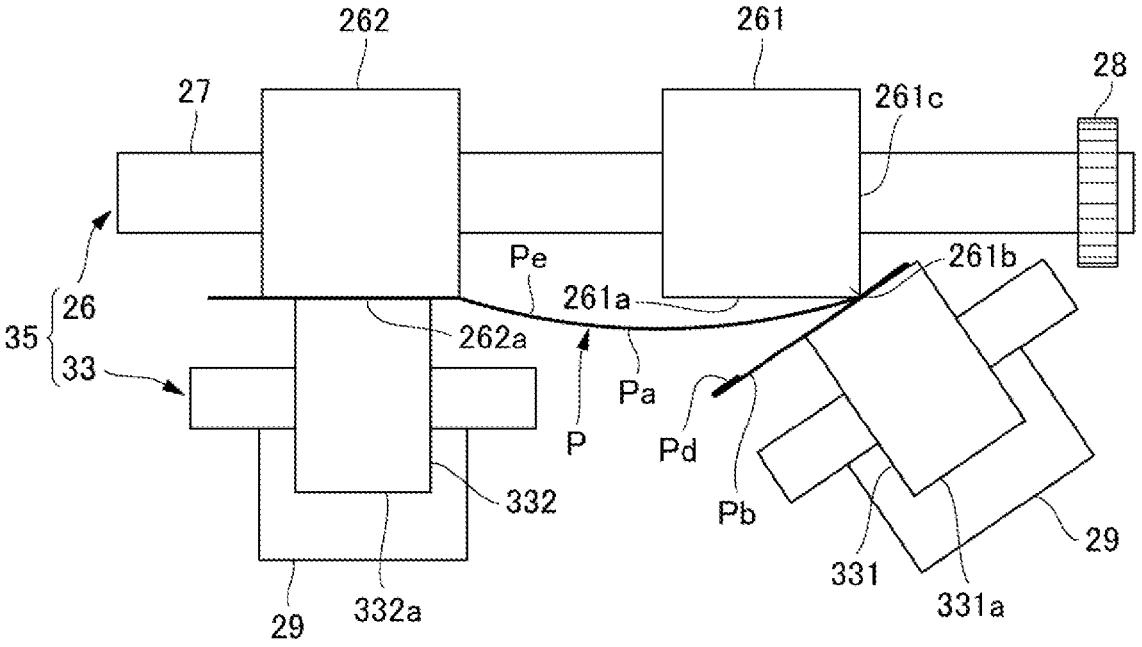
FIG. 4A illustrates a conveying roller pair of the image forming apparatus as viewed from the fixing device side.

FIG. 4A illustrates the conveying roller pair 35 as viewed from the fixing device 129 side. The conveying roller pair 35 includes the drive roller 26 and the driven roller 33, which serve as a pair of rotary members which rotates while nipping the envelope P having the toner image fixed thereon by the fixing device 129 to convey the envelope P.

The drive roller 26 includes a shaft 27 and rubber rollers 261 and 262 provided to the shaft 27. The rubber rollers 261 and 262 are each a roller made of rubber, which has a diameter of 15 mm and a width of 10 mm. The drive roller 26 includes the two divided rubber rollers, but may include one continuous rubber roller. A gear 28 is integrally provided to the shaft 27. The gear 28 meshes with a drive gear (not shown) which rotates by a drive motor (not shown).

The driven roller (one of the pair of rotary members) 33 includes two driven runners 331 and 332 divided in the rotary shaft center direction. The number of the driven runners may be three or more. In this case, regardless of the number of the driven runners, it is necessary that the rubber rollers of the drive roller 26 be located correspondingly to the driven runners.

Of the two driven runners 331 and 332, the driven runner 331 located at one end is inclined in a direction separating from the other driven runner 332. An intermediate part of an outer peripheral surface 331*a* of the inclined driven runner 331 is brought into contact with a corner portion (edge portion) 261*b* of the rubber roller 261. The driven runner 331 has a diameter of 15 mm and a width of 8 mm, and protrudes from the rubber roller 261 outwardly by about 4 mm. The driven runner 331 has its roller center shaft pressed by a wire spring 29 having a diameter of 0.3 mm in a bearing direction so as to be pressed against the corner portion 261*b* of the rubber roller 261. The corner portion 261*b* of the rubber roller 261 which is brought into contact with the inclined driven runner 331 is formed at a right angle between an outer peripheral surface 261*a* and an end surface 261*c* of the rubber roller 261.

An outer peripheral surface 332*a* of the driven runner 332 which is not inclined is brought into contact with an outer peripheral surface 262*a* of the rubber roller 262 in a manner that its roller center shaft is pressed by another wire spring 29 having a diameter of 0.3 mm in the bearing direction.

With this, the driven runners 331 and 332 are rotated in association to the rubber rollers 261 and 262, respectively. The driven runners 331 and 332 are formed by molding, and each has a surface layer coated with a fluorine resin.

Figures 5, 6:
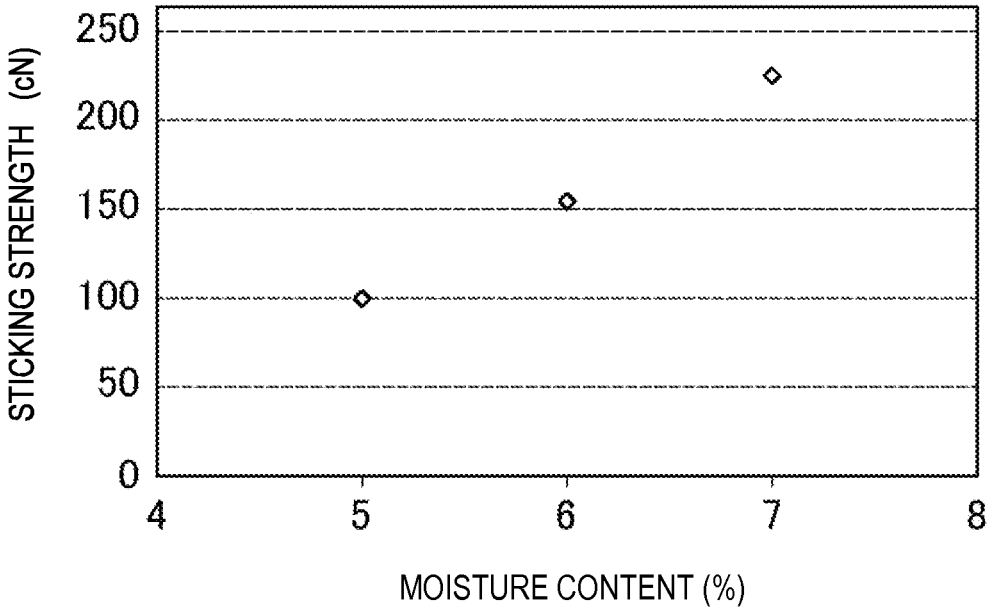
FIG. 5 is a graph showing a relationship between the moisture content of the envelope and the sticking strength.
FIG. 6 is a table showing a relationship between an inclination angle of the driven runner with respect to the rubber roller and a contact width between the driven runner and the rubber roller.

FIG. 5 is a graph showing a relationship between the moisture content of the envelope P and the sticking strength. It is understood from this graph that, as the moisture amount of the envelope P increases, the sticking strength with respect to the main body Pa of the envelope P increases. This is because, in a case where the moisture amount of the envelope P is large, a larger amount of water vapor is generated when the envelope P is heated at the fixing nip portion 22 of the fixing device 129, and hence the adhesive Pd applied to the flap Pb of the envelope P is easily dissolved.

FIG. 6 is a table showing a relationship between an inclination angle α (FIG. 4B) of the driven runner 331 with respect to the rubber roller 261, and a contact width between the driven runner 331 and the rubber roller 261. When the inclination angle of the driven runner 331 is 0°, the contact width between the driven runner 331 and the rubber roller 261 is 8 mm, while, when the driven runner 331 is inclined to have an inclination angle of 4°, the contact width is narrowed to 1 mm. It is understood from this fact that, as the driven runner 331 is gradually inclined, the contact width with respect to the rubber roller 261 becomes narrower.

Figure 7:
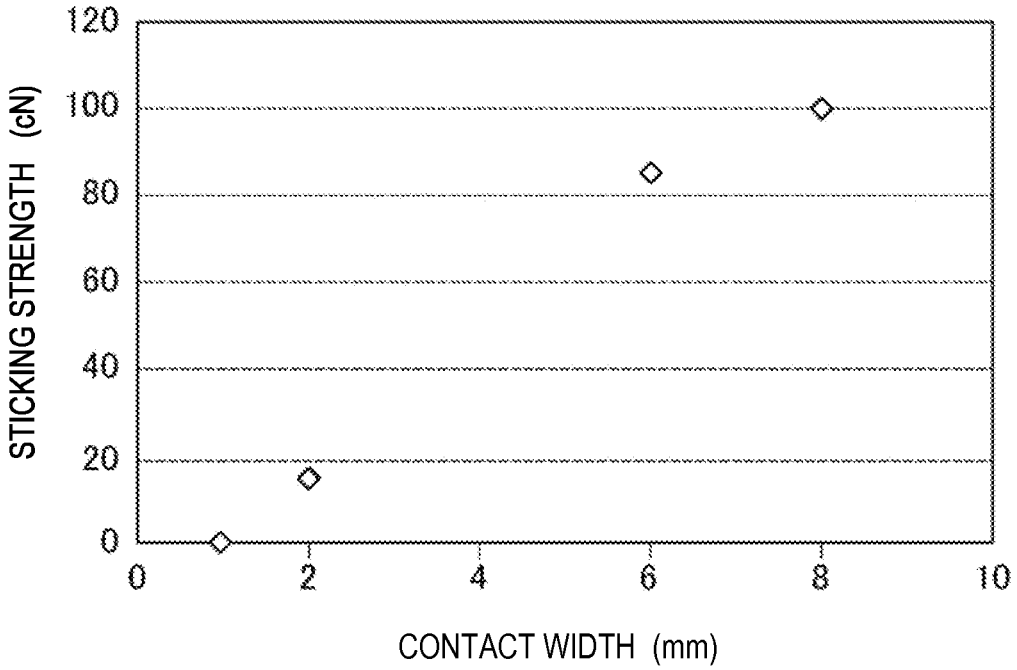
FIG. 7 is a graph showing a relationship between a contact width of the conveying roller pair and the sticking strength of the envelope.

FIG. 7 is a graph showing a relationship between the contact width of the conveying roller pair 35 with respect to the envelope P and the sticking strength of the envelope when the envelope having a moisture content of 5% is passed through the conveying roller pair 35. When the contact width is 8 mm, the sticking strength of the envelope is 100 cN, while, when the contact width is reduced to 1 mm, the sticking strength of the envelope becomes 0 cN and the flap Pb is less liable to stick to the main body Pa. It is understood from this fact that, as the contact width of the conveying roller pair 35 is decreased, the sticking strength of the envelope P is reduced and the flap Pb is less liable to stick to the main body Pa.

In FIGS. 1 to 7, the envelope P is sent between the photosensitive drum 121 and the transfer charging device 125 under a state in which the surface Pe (FIG. 3B) on which the address is to be written is directed toward the photosensitive drum 121, to thereby transfer the toner image of the address onto the envelope P. Then, the envelope P is sent to the fixing device 129 (FIG. 2) so that the surface Pe on which the address is to be written is heated by the film unit 20, and thus the toner image T of the address is fixed onto the surface Pe on which the address is to be written. After that, the envelope P is sent to the conveying roller pair 35.

Figure 4B:
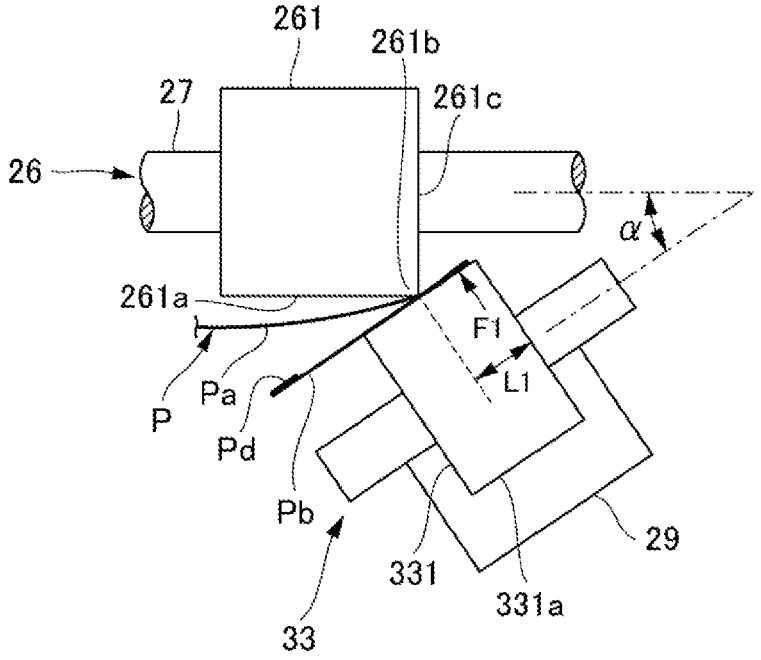
FIG. 4B is an enlarged view of an inclined driven runner and a rubber roller of the conveying roller pair in the image forming apparatus.

In FIGS. 4A and 4B, the envelope P sent to the conveying roller pair 35 has its parts of the main body Pa and the flap Pb nipped between the rubber roller 261 and the inclined driven runner 331, and a part of the main body Pa is nipped between the rubber roller 262 and the driven runner 332 to be conveyed.

At this time, the envelope P is conveyed under a state in which a part of the main body Pa and the flap Pb of the envelope P are bent by the outer peripheral surface 331*a* of the inclined driven runner 331 toward the rubber roller 261 at a force of F1 (FIG. 4B) with the corner portion 261*b* of the rubber roller 261 as a fulcrum. The driven runner 332 which is not inclined rotates while nipping the main body Pa of the envelope P together with the opposing rubber roller 262 between the outer peripheral surfaces 332*a* and 262*a* to convey the envelope P.

Therefore, the main body Pa is conveyed by the rotation of the rubber roller 261 and the driven runner 331 while being nipped therebetween, and by the rotation of the rubber roller 262 and the driven runner 332 while being nipped therebetween. However, the flap Pb is conveyed merely by the rotation of the rubber roller 261 and the driven runner 331 while being nipped therebetween.

Therefore, the flap Pb is conveyed under a state in which the flap Pb is separated from the main body Pa because the flap Pb is bent toward the rubber roller 261 with the corner portion 261*b* of the rubber roller 261 as a fulcrum and due to the stiffness and the self weight of the flap. Thus, the flap Pb is less liable to stick to the main body Pa.

When the flap Pb is separated from the main body Pa, there is formed a space for allowing the water vapor generated from the main body Pa to escape without accumulating the water vapor between the main body Pa and the flap Pb. Thus, it is possible to prevent the adhesive Pd from being dissolved and prevent the flap Pb from sticking to the main body Pa.

Even in a case where the flap Pb flutters when the conveying roller pair 35 conveys the envelope, the inclined driven runner 331 inclines the flap Pb, and hence it is possible to suppress the fluttering of the flap and achieve smooth conveyance.

The envelope P is pressed against the corner portion 261*b* of the rubber roller 261 by the driven runner 331. Therefore, the contact width between the driven runner 331 and the corner portion 261*b* of the rubber roller 261 is almost zero. Therefore, as shown in FIG. 7, the flap Pb has almost no sticking strength, and hardly sticks to the main body Pa.

The driven runner 331 has its intermediate part of the outer peripheral surface 331*a* brought into contact with the corner portion 261*b* of the rubber roller 261, and is protruded outwardly in the shaft direction of the rubber roller. Therefore, the probability to separate the flap from the main body can be increased by the part having a protruding length of L1 (FIG. 4B).

In FIG. 7, the contact width is about 1 mm at the minimum. This is because the corner portion 261*b* of the rubber roller 261 is pressed by the driven runner 331 to be elastically deformed and slightly flattened. This slightly flattened part enables the conveyance of the envelope P even when the envelope P is pressed against the corner portion 261*b* of the rubber roller 261.

As illustrated in FIG. 4A, in the conveying roller pair 35, merely the driven runner 331 on one side is inclined. However, as a conveying roller pair 235 illustrated in FIG. 8, the driven runners 331 and 332 at both ends of a driven roller 233 may be inclined by the same angle α in a direction separating from each other. Also in this case, the intermediate parts of the outer peripheral surfaces 331*a* and 332*a* of the driven runners 331 and 332 are brought into contact with corner portions (edge portions) 261*b* and 262*b* of the rubber rollers 261 and 262, respectively. The corner portion 262*b* of the rubber roller 262 is formed at a right angle between the outer peripheral surface 262*a* and an end surface 262*c* of the rubber roller 262. Also the corner portion 262*b* of the rubber roller 262 is pressed by the driven runner 332 to be elastically deformed and slightly flattened.

Figure 8:
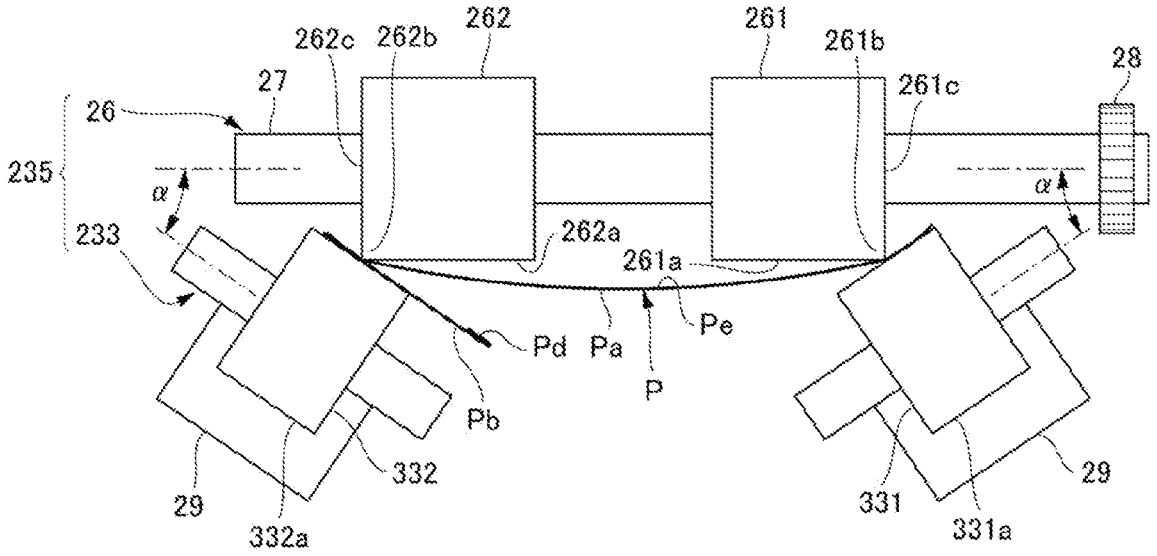
FIG. 8 illustrates the conveying roller pair in a case where the driven runners on both sides are inclined in directions separating from each other in FIG. 4A.

In the case where both of the driven runners 331 and 332 are inclined, no matter which side the flap Pb is directed as illustrated in FIGS. 4A and 8 when the envelope P is conveyed, the flap Pb can be separated from the main body Pa, and the flap Pb can be prevented from being stuck to the main body Pa.

Figure 9A:
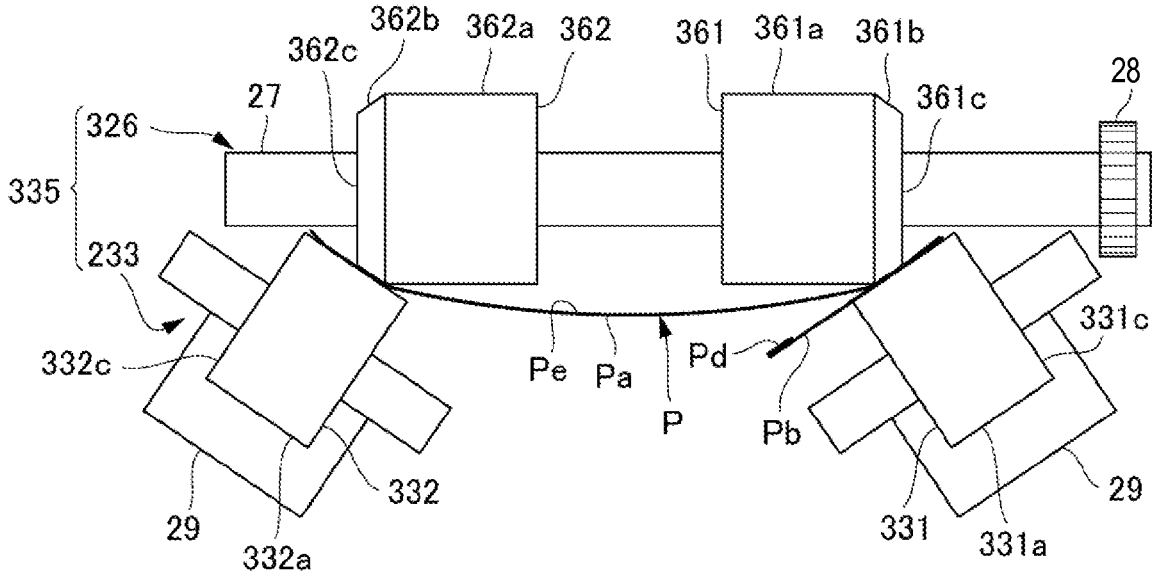
FIG. 9A illustrates the conveying roller pair in a case where the driven runners on both the sides are inclined when each of the rubber rollers includes a tapered portion in FIG. 8.

In a conveying roller pair 335 illustrated in FIG. 9A, edge portions of rubber rollers 361 and 362 of a drive roller 326 are tapered portions 361*b* and 362*b*, respectively. The tapered portion 361*b* of the rubber roller is formed between an outer peripheral surface 361*a* and an end surface 361*c* of the rubber roller by being inclined in the same direction as the driven runner 331. The tapered portion 362*b* of the rubber roller is formed between an outer peripheral surface 362*a* and an end surface 362*c* of the rubber roller by being inclined in the same direction as the driven runner 332. The inclinations of the tapered portions 361*b* and 362*b* are the same or substantially the same as the inclinations of the driven runners 331 and 332. The rubber rollers 361 and 362 each have a shape with a diameter of 15 mm and a width of 10 mm, and the corners are cut to form the tapered portions 361*b* and 362*b*.

The tapered portions 361*b* and 362*b* of the rubber rollers are brought into contact with the intermediate parts of the outer peripheral surfaces 331*a* and 332*a* of the driven runners 331 and 332, respectively. The driven runners 331 and 332 each have a diameter of 15 mm and a width of 10 mm.

When the edge portions of the rubber rollers 361 and 362 are the tapered portions 361*b* and 362*b*, respectively, even with long-term use, the edge portion of the rubber roller is less liable to wear and deform, and the envelope can be conveyed in a stable state for a long period.

Figure 9B:
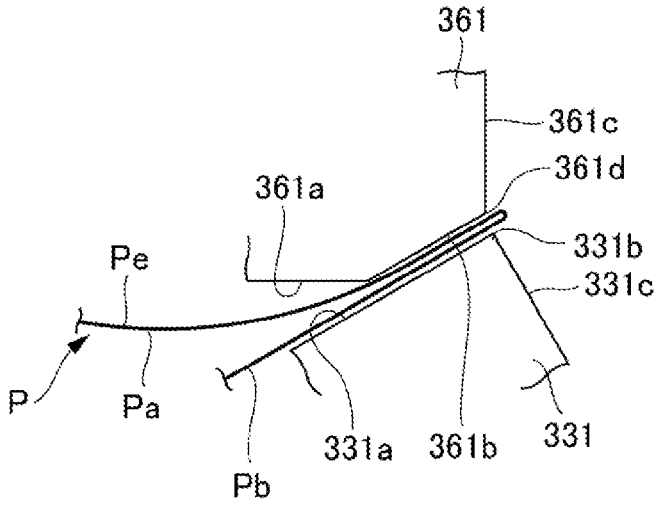
FIG. 9B illustrates a state in which end surfaces of the rubber roller and the driven runner are aligned in the conveying roller pair in the case where the rubber roller includes the tapered portion in FIG. 8.
Figure 10:
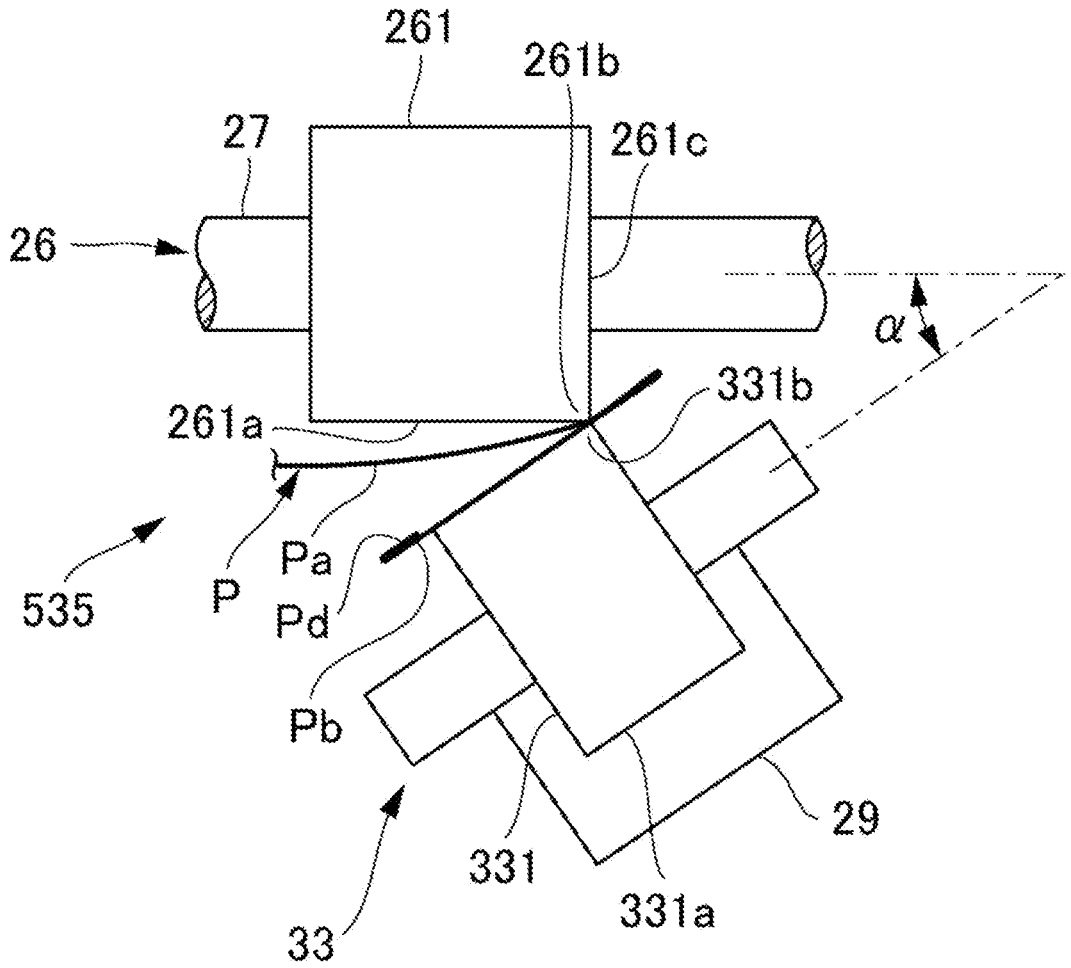
FIG. 10 illustrates an embodiment in a case where corners of the rubber roller without the tapered portion and the driven runner are brought into abutment with each other.

As illustrated in FIG. 9B, a corner portion 331*b* between an end surface 331*c* and the outer peripheral surface 331*a* of the driven runner 331 may be located at a position that abuts against a corner portion 361*d* between the end surface 361*c* and the tapered portion 361*b* of the rubber roller 361. Further, as a conveying roller pair 535 illustrated in FIG. 10, the corner portion 261*b* of the rubber roller 261 without the tapered portion and the corner portion 331*b* of the driven runner 331 may be brought into abutment against each other. Although not illustrated, similarly to FIG. 9B, a corner portion between an end surface 332*c* and the outer peripheral surface of the driven runner 332 may also be brought into abutment against a corner portion between the end surface 362*c* and the outer peripheral surface of the rubber roller 362. The driven roller 233 of the conveying roller pair 335 is similar to the driven roller 233 illustrated in FIG. 8, and hence description thereof is omitted.

When the corner portion of each of the driven runners 331 and 332 and the corner portion of each of the rubber rollers 361 and 362 are brought into abutment with each other, the length that each of the driven runners 331 and 332 protrudes outwardly in the shaft direction of each of the rubber rollers 361 and 362 is smaller than that in the case of FIG. 8. As a result, the width of the conveying roller pair 335 can be reduced.

Figure 11:
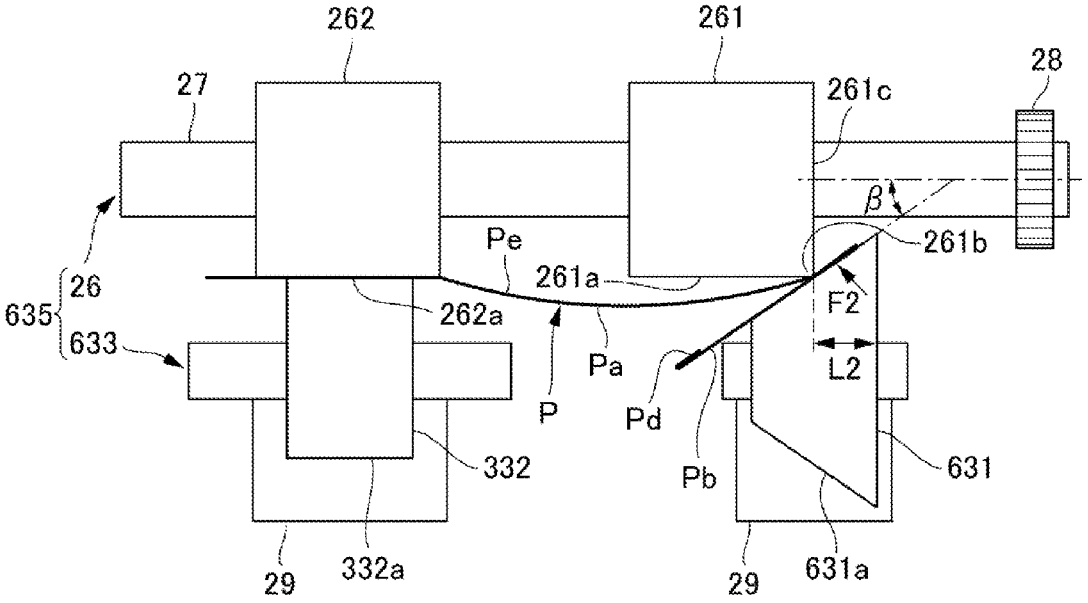
FIG. 11 illustrates an embodiment of a case where the rubber roller does not include the tapered portion and the driven runner is formed into a truncated cone shape in FIG. 9A.

As a conveying roller pair 635 illustrated in FIG. 11, the corner portion 261*b* of the rubber roller 261 without the tapered portion and an outer peripheral surface 631*a* as a tapered portion of a truncated cone shaped driven runner 631 may be brought into abutment against each other. The inclination of the outer peripheral surface 631*a* of the driven runner 631 with respect to the rubber roller 261 is β. Also in this case, the driven runner 631 has its intermediate part of the outer peripheral surface 631*a* brought into contact with the corner portion 261*b* of the rubber roller 261, and is protruded outwardly in the shaft direction of the rubber roller 261. Therefore, the probability to separate the flap from the main body can be increased by the part having a protruding length of L2. The envelope P is conveyed under a state in which a part of the main body Pa and the flap Pb of the envelope P are bent by the outer peripheral surface 631*a* of the truncated cone shaped driven runner 631 toward the rubber roller 261 at a force of F2 with the corner portion 261*b* of the rubber roller 261 as a fulcrum.

The conveying roller pairs 35, 235, 335, 535, and 635 described above each convey the envelope while aligning the surface Pe of the envelope, on which the address is to be written, to the position of the photosensitive drum 121. Therefore, the drive rollers 26 and 326 are each arranged on the upper side, and the driven rollers 33, 233, and 633 are each arranged on the lower side. However, when the relationship in arrangement of the image forming portion 133 in FIG. 1 is reversed so that the photosensitive drum 121 is provided on the lower side and the transfer charging device 125 and the separation charging device 126 are provided on the upper side, the conveying roller pairs 35, 235, 335, 535, and 635 are also required to be reversed.

Figure 12:
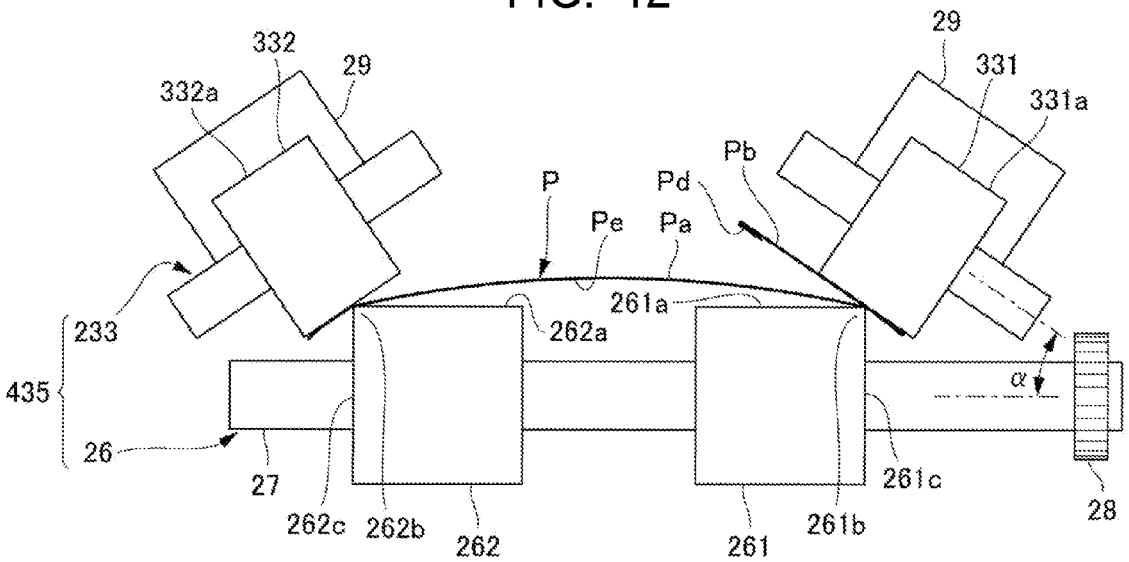
FIG. 12 illustrates the conveying roller pair in a case where the conveying roller pair of FIG. 8 is arranged in a reversed manner.

In a conveying roller pair 435 illustrated in FIG. 12, the conveying roller pair 235 illustrated in FIG. 8 is arranged in a reversed manner so that the driven roller 233 is provided on the upper side and the drive roller 26 is provided on the lower side. Similarly, even when the conveying roller pair 35 illustrated in FIGS. 4A and 4B, and the conveying roller pair 335 illustrated in FIGS. 9A and 9B are arranged in a reversed manner, those conveying roller pairs can support an image forming unit in which the relationship in arrangement is reversed. Even with the reversed conveying roller pair, the flap can be separated from the main body to prevent the flap from sticking to the main body. Note that, in the case of the reversed conveying roller pair, as illustrated in FIG. 12, the envelope P is located on the upper side of the drive roller 26. Therefore, the main body Pa of the envelope P separates from the flap Pb by its own weight to try to settle onto the drive roller 26. Therefore, even without one driven runner 332, the main body Pa can be separated from the flap Pb. Therefore, in conveying roller pairs having the reversed configurations of the conveying roller pairs of FIGS. 4A, 4B, 8, 9A, and 9B, one driven runner 332 is not always necessary.

Figure 13:
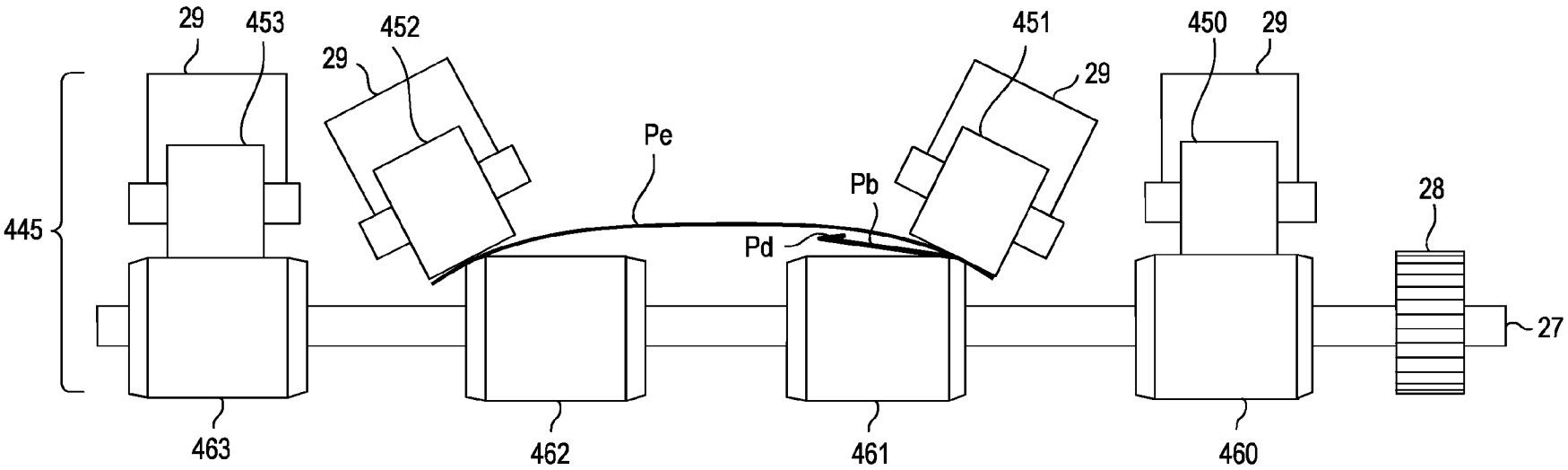
FIG. 13 illustrates the conveying roller pair in a case where the conveying roller pair of FIG. 9A is arranged in a reversed manner.

In conveying roller pairs 445 illustrated in FIG. 13, the conveying roller pair 335 illustrated in FIG. 9A is arranged in a reversed manner so that the driven roller 233 is provided on the upper side and the drive roller 26 is provided on the lower side. The surface Pe, on which the address is to be written, of the conveyed envelope is directed on the side of a driven runner 450, and the flap Pb is directed on the side of a drive roller 460. In the conveying roller pairs 445 which are arranged in the reversed manner, the water vapor generated from the main body Pa of the envelope does not accumulate between the main body Pa of the envelope and the flap Pb. Thereby, it is possible to prevent the adhesive Pd from being dissolved and prevent the flap Pb from sticking to the main body Pa of the envelope.

Moreover, an amount of curvature of the main body Pa of the envelope on the side of the driven runner becomes larger by bringing an intermediate part of an outer peripheral surface of an inclined driven runner 451 into contact with a corner portion (an edge portion) of a drive roller 461. Thus, for as much as a leading end of the flap Pb sufficiently separates from the main body Pa of the envelope, a space between the main body Pa of the envelope and the flap Pb can be extended. Since an adhesion portion of the flap Pb separates from the main body Pa of the envelope, the water vapor generated from the main body Pa of the envelope does not accumulate between the main body Pa of the envelope and the flap Pb. Thereby, it is possible to prevent the adhesive Pd from being dissolved and prevent the flap Pb from sticking to the main body Pa.

Figure 14:
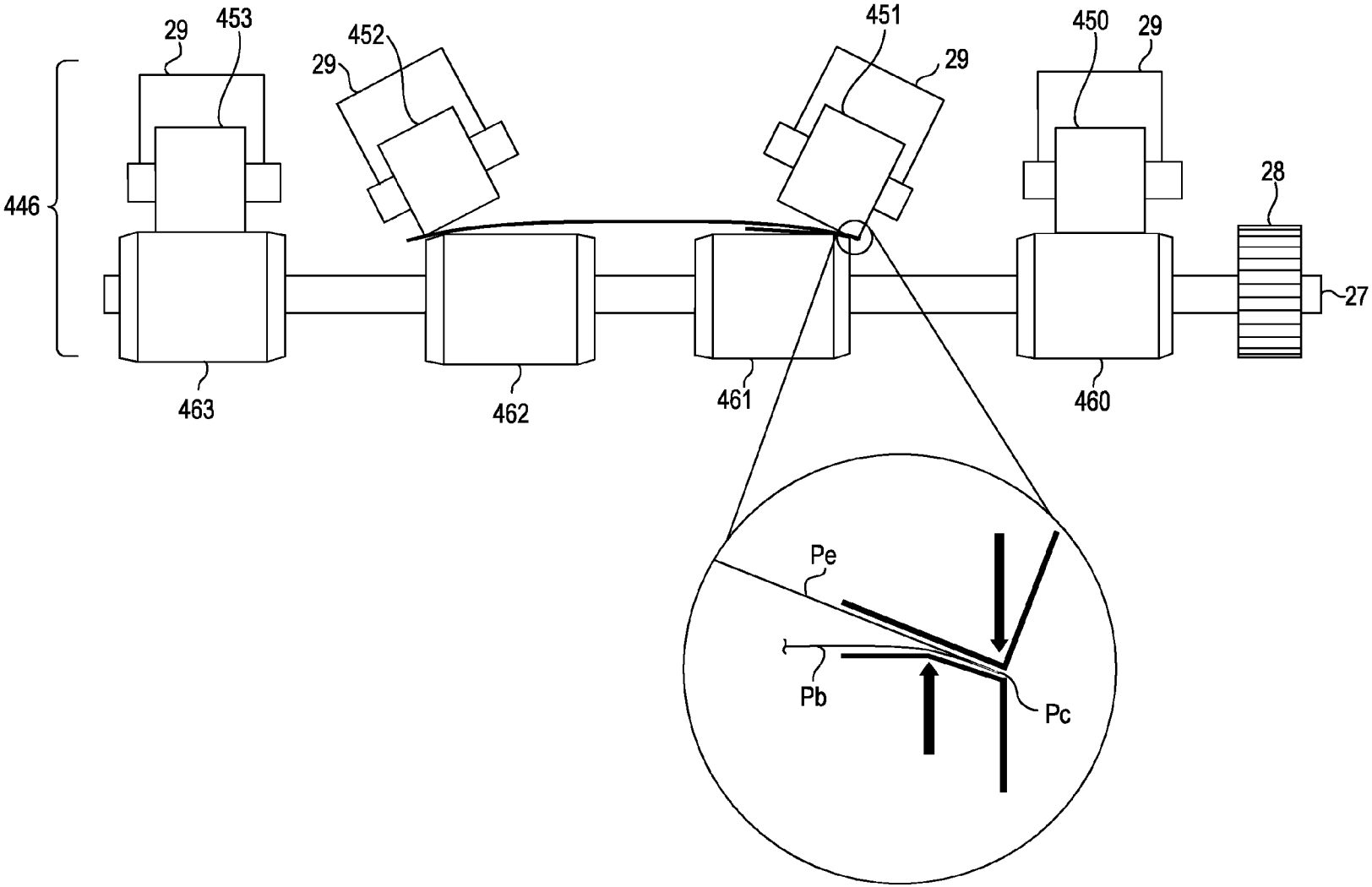
FIG. 14 illustrates a main body of the envelope which is curved toward a driven runner, and an enlarged view of a corner portion of a drive roller and a corner portion of the driven runner is illustrated in the circle.

In conveying roller pairs 446 illustrated in FIG. 14, the main body Pa of the envelope is curved toward the side of the driven runner with a corner portion of the driven runner 451 and the corner portion of the drive roller 461 as a fulcrum. Even if it is in this manner, the flap Pb separates from the main body Pa of the envelope to form a space, and the water vapor generated from the main body Pa of the envelope does not accumulate between the main body Pa of the envelope and the flap Pb. Thereby, it is possible to prevent the adhesive Pd from being dissolved and prevent the flap Pb from sticking to the main body Pa.

In the conveying roller pairs 445, 446, a conveying roller pair which does not nip and convey the envelope is arranged on the outer side of the envelope. Thus, a recording medium having a larger size than the envelope can also be conveyed.

In the conveying roller pair of the conveying roller pairs which is at a position opposing to the driven runner 451 of the conveying roller pair nipping and conveying the flap Pb with the main body Pa of the envelope being disposed therebetween, a conveying surface of the driven runner 452 is inclined in an opposite direction. Accordingly, an amount of curvature of the main body Pa of the envelope on the side of the driven runner becomes larger than that in a case where it is inclined on the side of the flap Pb. Thus, a space between the main body Pa of the envelope and the flap Pb can be extended, and the water vapor generated from the main body Pa of the envelope does not accumulate between the main body Pa of the envelope and the flap Pb. Thereby, it is possible to prevent the adhesive Pd from being dissolved and prevent the flap Pb from sticking to the main body Pa. Furthermore, the drive roller 461, 462 have the tapered portions at the corner portions of the rollers as the drive roller illustrated in FIGS. 9A, 9B. Thus, the amount of curvature of the envelope to be nipped and conveyed can be larger than that of a roller which has no tapered portion.

The above mentioned conveying roller pairs are respectively an example of a conveying unit of the present invention, and the conveying pair of the conveying roller pairs, which includes the driven runner having the inclined surface, is an example of a first conveying unit of the present invention, and other conveying rollers are respectively an example of a second conveying unit of the present invention.

The conveying roller pairs described above, which are illustrated in FIGS. 4A, 4B, and 8 to 12, are all configured so that, with respect to an envelope conveying path 128*a* formed by the conveying portion 128 (FIG. 1), the film unit 20 of the fixing device and each of the driven rollers 33 and 233 are arranged opposite to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-147806, filed Jun. 29, 2012, which is hereby incorporated by reference herein in its entirety.

What is claimed is:

1. An image forming apparatus, comprising:

an image forming unit that forms a toner image on an envelope;

a fixing unit that fixes the toner image onto the envelope by heating the envelope while conveying the envelope on which the toner image is formed by the image forming unit; and a conveying unit that conveys the envelope, onto which the toner image is fixed by the fixing unit, so as not to nip a leading end side of a flap of the envelope and to nip a fold line side of the flap so that an adhesion portion of the flap is prevented from adhering to a main body of the envelope.

2. An image forming apparatus according to claim 1, wherein the conveying unit includes pairs of rotary members nipping and conveying the envelope, and wherein a conveying surface of one rotary member in a first pair of rotary members, which nips and conveys the flap, of the pairs of rotary members is inclined with respect to a conveying surface of another rotary member in the first pair of rotary members, which nips and conveys the flap, so as not to nip a leading end of the flap.

3. An image forming apparatus according to claim 2, wherein the conveying surface of the one rotary member is brought into contact with an edge portion of the conveying surface of the other rotary member.

4. An image forming apparatus according to claim 2, wherein an edge portion of the conveying surface of the one rotary member is brought into contact with an edge portion of the conveying surface of the other rotary member.

5. An image forming apparatus according to claim 2, wherein an edge portion of the other rotary member is a corner portion of the other rotary member, and wherein the corner portion is brought into contact with an intermediate part of the conveying surface of the one rotary member.

6. An image forming apparatus according to claim 2, wherein an edge portion of the other rotary member is a tapered portion of the other rotary member, and which is inclined in the same direction of the conveying surface of the one rotary member, and wherein the tapered portion is brought into contact with the conveying surface of the one rotary member.

7. An image forming apparatus according to claim 2, wherein the one rotary member is brought into contact with the flap of the envelope.

8. An image forming apparatus according to claim 2, wherein the pairs of rotary members includes a second pair of rotary members which nip and convey the envelope together with the first pair of rotary members, and wherein one rotary member in the second pair of rotary members is inclined with respect to a conveying surface of another rotary member in the second pair of rotary members so that the one rotary member in the second pair of rotary members and the conveying surface of the one rotary member in the first pair of rotary members are inclined symmetrically.

9. An image forming apparatus according to claim 8, wherein the second pair of rotary members nip an area of the envelope other than the flap.

10. An image forming apparatus according to claim 2, wherein the pairs of rotary members includes a second pair of rotary members which nip and convey the envelope together with the first pair of rotary members, and wherein, in the second pair of rotary members, a conveying surface of one rotary member is not inclined with respect to a conveying surface of another rotary member.

11. An image forming apparatus according to claim 1, wherein the conveying unit conveys the envelope so as to nip the fold line side of the flap so that a leading end of the flap separates from the main body of the envelope.

* * * * *